US007487572B2

(12) United States Patent
Nelson

(10) Patent No.: US 7,487,572 B2
(45) Date of Patent: Feb. 10, 2009

(54) HINGE MOTION CHECK FRICTION DEVICE, METHODS INCORPORATING THE DEVICE, AND USES THEREOF

(75) Inventor: Kenneth W. Nelson, South Lyon, MI (US)

(73) Assignee: E.I. Du Pont de Nemours & Company, Wilmington, DE (US)

( * ) Notice: Subject to any disclaimer, the term of this patent is extended or adjusted under 35 U.S.C. 154(b) by 252 days.

(21) Appl. No.: 11/244,767

(22) Filed: Oct. 6, 2005

(65) Prior Publication Data

US 2006/0277718 A1 Dec. 14, 2006

Related U.S. Application Data

(60) Provisional application No. 60/616,984, filed on Oct. 8, 2004.

(51) Int. Cl.
*E05F 5/02* (2006.01)
*E05D 11/10* (2006.01)

(52) U.S. Cl. ..... 16/334; 16/374; 16/82; 16/333

(58) Field of Classification Search ..... 16/342, 16/344, 332, 334, 335, 321, 374, 375, 322, 16/341, 333, 82; 296/146.11, 146.12
See application file for complete search history.

(56) References Cited

U.S. PATENT DOCUMENTS

| | | | | |
|---|---|---|---|---|
| 1,406,683 | A * | 2/1922 | Regan | 220/845 |
| 2,259,821 | A * | 10/1941 | Johnson | 16/375 |
| 2,504,351 | A * | 4/1950 | Ring | 16/342 |
| 5,924,170 | A | 7/1999 | Papke | |
| 5,950,281 | A * | 9/1999 | Lu | 16/342 |
| 6,085,388 | A * | 7/2000 | Kaneko | 16/338 |
| 6,108,866 | A | 8/2000 | Waynick, Jr. | |
| 6,220,759 | B1 * | 4/2001 | Lu | 384/398 |
| 6,230,365 | B1 * | 5/2001 | Lu | 16/342 |
| 6,332,243 | B1 | 12/2001 | Kim | |
| 6,334,236 | B1 * | 1/2002 | Kalliomaki | 16/334 |
| 6,568,741 | B1 * | 5/2003 | Leung et al. | 296/146.11 |
| 6,901,634 | B2 * | 6/2005 | Shaw et al. | 16/344 |
| 2004/0148739 | A1 | 8/2004 | Smith | |
| 2007/0094844 | A1 * | 5/2007 | Nelson | 16/337 |

FOREIGN PATENT DOCUMENTS

EP 0 539 206 A1 4/1993

* cited by examiner

*Primary Examiner*—Chuck Y. Mah
(74) *Attorney, Agent, or Firm*—William Hamby

(57) ABSTRACT

Hinge motion check friction device for incorporating into a hinge assembly useful for holding a hinge open at an selected position. The hinge motion check friction device is useful for incorporating into vehicle door hinges, particularly when the vehicle is being painting during manufacturing.

13 Claims, 2 Drawing Sheets

HINGE MOTION CHECK FRICTION DEVICE, METHODS INCORPORATING THE DEVICE, AND USES THEREOF

CROSS REFERENCE TO RELATED APPLICATIONS

This application claims the benefit of U.S. Provisional Application No. 60/616,984, filed Oct. 8, 2004.

FIELD OF THE INVENTION

The present invention relates to a hinge motion check friction device for incorporating into a hinge assembly for holding a hinge open at a selected position. In particular, the present invention is useful for incorporating into vehicle door hinges, particularly when the vehicle is being painting during manufacturing, so that the door remains in a desirable fixed position to facilitate painting operations.

BACKGROUND OF THE INVENTION

Hinges are widely used to connect two or more members, allowing them to rotate relative to one another. Examples of the use of hinges include connecting lids to containers and doors to frames. They are often designed to rotate relatively freely between preset stopping points, such as fully open or fully closed positions. However, in many instances it would be desirable to be able to reversibly position the members at a selected position relative to one another in such a way that they are both held in position and do not further rotate relative to each other in normal use but can be further moved to other selected positions by the use of a force that is greater than that experienced by the members during normal use. By "reversibly position" is meant that the members can be repeatedly moved relative to one another from the position in which they were initially placed, and maintained in that subsequent position regardless of movement of the body to which the members are attached.

The use of such a hinge device would be particularly useful in vehicle doors, and in particular during the vehicle manufacturing process. During manufacturing, vehicles such as automobiles are often painted in a multi-step process on assembly lines. During the painting process, it is often necessary to open, close, and otherwise adjust the positions of doors connected to the bodies of vehicles by hinges relative to the bodies, often in an automated fashion by robots. Doors can be placed and held in desired positions using wire forms or metal brackets, but these supports must be individually installed, adjusted, and removed, which requires intervention by a worker and thus adds complexity to the painting process. Furthermore, after a few cycles in the painting process, it is often necessary to clean the supports, making this technique still more complex and labor-intensive.

It is known to insert a tightly-fitting plastic collar device around a vehicle door hinge pin. The plastic collar has a tab that interlocks the collar to the side of the hinge attached to the door. The collar serves to provide resistance to door rotation. However, during the painting process, the vehicles can go through several heating and cooling steps during which the maximum temperature can reach or exceed 120° C., which can cause the plastic collar to lose its grip on the hinge pin as the plastic is annealed and expands and contracts during the heating and cooling cycles. This can lead to inconsistent and unreliable operation of the device as it will often fail to hold the door firmly in a desired position. Thus a device that can withstand several heating and cooling cycles without losing its grip on a hinge pin would be desirable.

It is an object of the present invention to obtain a device capable of holding two members connected by one or more hinges in an selected position between or including fully open (meaning the hinge surfaces maintain the members as far apart as possible) or fully closed (meaning that the hinge surfaces maintain the members in closest proximity to one another) that did not require the use of supports that must be manually removed and reinstalled each time the position of the members needed to be changed. A feature of the present invention is in one embodiment the use of such a device in a vehicle door hinge assembly. An advantage of the present invention is that such a device can withstand the forces imparted on the vehicle by the jerky motion and starting and stopping of many conveyer operations by not preventing the vehicle door from moving significantly from its set position. These and other objects, features and advantages of the invention will become better understood upon having reference to the detailed description herein.

SUMMARY OF THE INVENTION

There is disclosed and claimed herein a hinge motion check friction device for holding a hinge connecting at least two members at an arbitrary position, comprising a collar containing an opening into which is inserted a metal sleeve such that the collar and the metal sleeve are in contact and wherein the collar comprises a tab.

Alternatively there is disclosed and claimed herein an improvement for a device for frictionally connecting hinge members at a selected position, comprising a collar containing an opening into which is inserted a metal sleeve such that the collar and the metal sleeve are in contact. The improvement comprises the metal sleeve frictionally secured within the collar and a tab secured to the collar which maintains the hinge members in the position selected.

The present invention will become better understood upon having reference to the drawings herein.

DETAILED DESCRIPTION OF THE INVENTION

The friction device of the present invention comprises a collar into which is inserted a metal split tubular sleeve that is interlocked with the collar and through which a hinge pin connecting two or more hinge members is inserted, such that once inserted into the collar, the sleeve is rotationally fixed to the collar and cannot rotate within the collar and can only follow the rotational movement of the collar, should the collar be rotated. The hinge pin is interlocked with one of the hinge members. The collar comprises a tab that interlocks one or more hinge members that are different from the hinge member to which the hinge pin is interlocked, thus impeding relative motion of the hinge members. As used herein, by the term "interlocked", it is meant that whenever a first part is in intimate contact with a second, separate part, any force applied to the first part to create movement in a particular direction causes simultaneously an equal movement of the second part in the same general direction.

Figure 1:
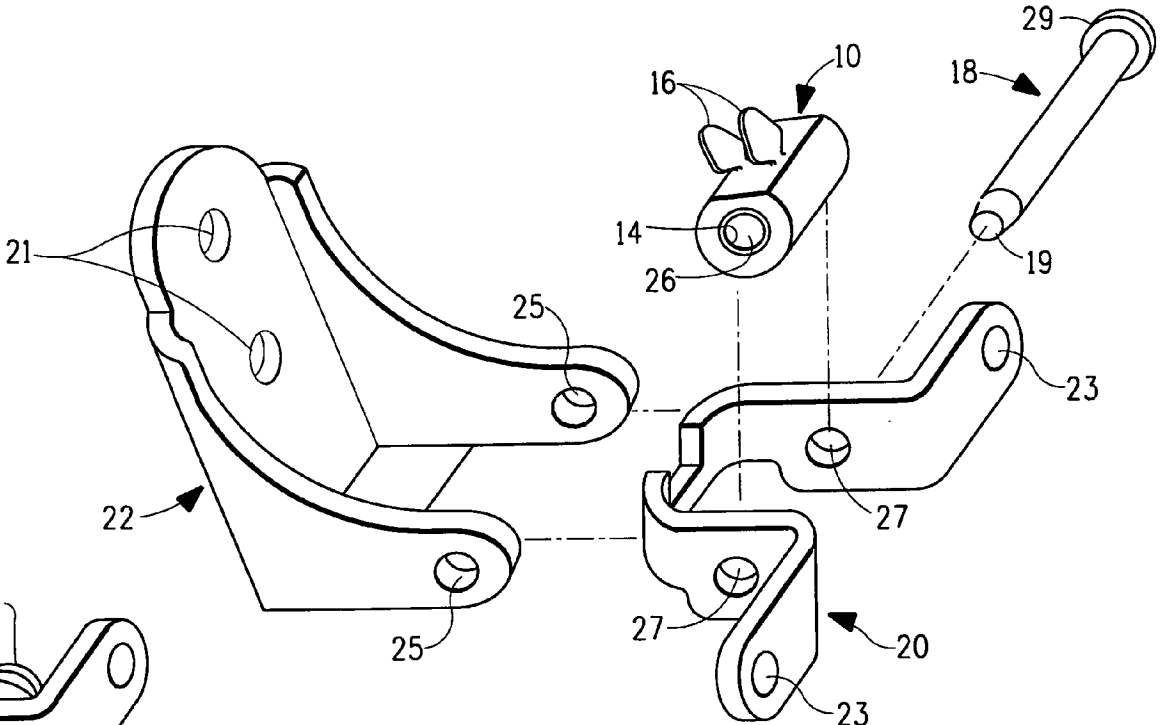
FIG. 1 is an exploded view of an unassembled vehicle hinge assembly containing a hinge motion check friction device according to the present invention.

Having reference to FIG. 1, there is shown generally at 10 the friction device of the present invention, comprising a collar 12. A metal tubular sleeve 14 (shown in detail in FIG. 5 herein) is inserted into the opening 26 of collar 12. The collar 12 further comprises at least one tab 16. In one embodiment of the present invention, a vehicle door hinge pin 18 may be inserted through the center of the friction device 10. The hinge pin 18 fastens door-side hinge member 20 (which is secured to a door by fastening means not shown through apertures 23 formed therein) to body-side hinge member 22 (which is secured to a body by fastening means not shown through apertures 21 formed therein). The internal diameter of the metal sleeve 14 is smaller than the diameter of the hinge pin 18 although sufficiently large to allow the insertion of the hinge pin 18 therethrough. The hinge pin 18 may include a tapered end 19 to facilitate this insertion. When the hinge pin 18 is inserted through the friction device 10, the metal sleeve 14 expands in diameter, creating significant friction between friction device 10 and the hinge pin 18, such that the friction device 10 does not freely rotate around the hinge pin 18.

To complete the assembly depicted in FIG. 1, the hinge pin 18 is first inserted first through either of two apertures 25 of body-side hinge member 22, followed by aperture 27 aligned thereto of door-side hinge member 20. The hinge pin 18 next extends through the friction device 10 as described above, and finally is inserted through the remaining apertures 27 and 25 respectively. Once inserted, the pin head 29 of the hinge pin 18 contacts the outermost surface of the body-side hinge member 22.

Figure 2:
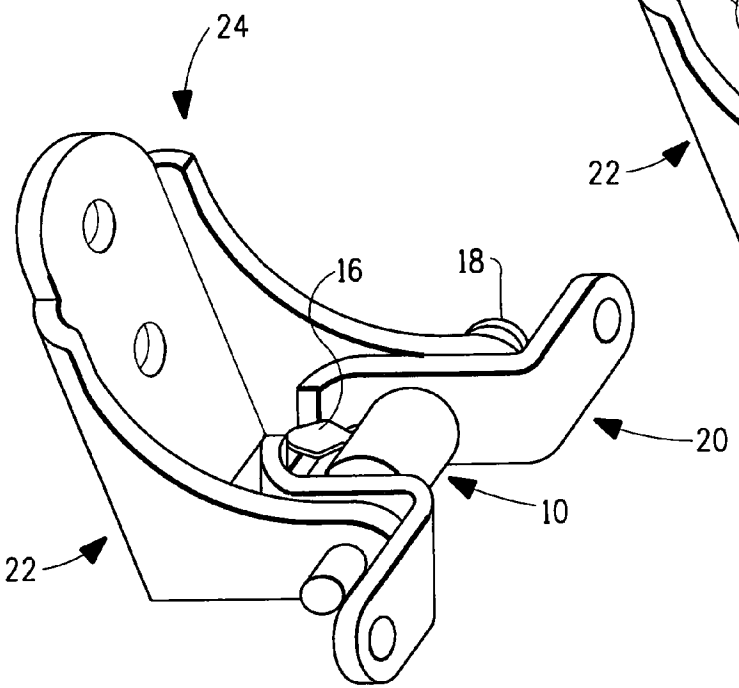
FIG. 2 is a view of an assembled vehicle hinge assembly containing a hinge motion check friction device according to the present invention.

Having reference to FIG. 2, there is shown generally at 24 a hinge as depicted in FIG. 1 and now assembled as described above, with the hinge pin 18 inserted through friction device 10 and door-side hinge member 20 and body-side hinge member 22. One or more assembled hinges 24 may be used to attach a vehicle door to the body of a vehicle, preferably an automobile. Preferably, door-side member 20 will be attached to the door and body-side hinge member 22 will be attached to the body. Tab 16 is designed such that it contacts either door-side hinge member 20 or body-side hinge member 22, and serves as an interlock to couple the frictional resistance to rotation in either direction between the friction device 10 and hinge pin 18. In so-doing, the tab transfers a rotational force from the door hinge to the collar, forcing the friction device 10 to rotate around the hinge pin 18 to follow the door and overcoming the friction between the friction device 10 and hinge pin 18 in the process. In one embodiment of the present invention, contact between tab 16 and the hinge member may be through a hole in the hinge member into which the tab is inserted.

Hinge pin 18 is interlocked to one of the hinge members. When tab 16 is designed such that it contacts the door-side hinge member 20, hinge pin 18 is interlocked with body-side hinge member 22. When tab 16 is designed such that it contacts body-side hinge member 22, hinge pin 18 is interlocked with door-side hinge member 20. Hinge pin 18 may be interlocked with the appropriate hinge member by serrations, scoring, grooves, or other details present in on the hinge pin that mate with complimentary serrations, scoring, groove, or other details on the hinge member when the hinge pin 18 is inserted into the hinge member. Any other suitable method of interlocking hinge pin 18 to the hinge member may also be employed. When sufficient force is applied to the hinge, door-side hinge member 20 will rotate relative to body-side hinge member 22. However, the frictional resistance is great enough that absent such force, door-side hinge member 20 and body-side hinge member 22 will maintain their relative positions, particularly when used to mount a vehicle door to a vehicle that is conveyed along a painting line. As the vehicle moves along the painting line, the position of the door may be adjusted as needed by the application of force sufficient to overcome the frictional resistance between friction device 10 and hinge pin 18. However, the frictional resistance will be sufficient to keep the door in place when subjected to normal motion along the line, which can include jolts from starting and stopping the line, even after subjected to repeated heating and cooling cycles.

Figure 3:
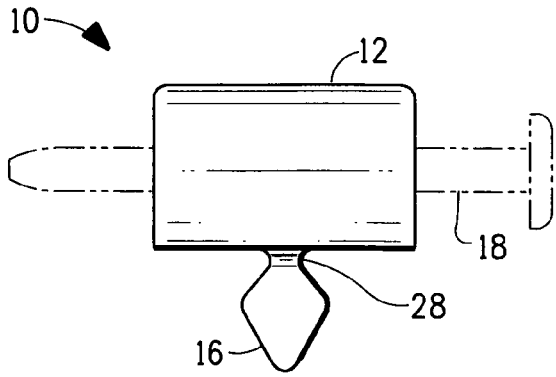
FIG. 3 is a side view of a hinge motion check friction device according to the present invention into which a hinge pin has been inserted.

Tab 16 is designed such that it may be conveniently removed from contacting a hinge member when it is no longer desirable to hold the hinge members in an selected position, such as when free motion between the members is desired. As shown in FIG. 3, tab 16 is preferably connected to collar 12 by a narrow neck 28. This allows tab 16 to be conveniently broken or cut off when, for example, the painting/assembly operation of a vehicle is complete. It is readily appreciated that other designs of the tab 16 can be incorporated to allow convenient breakage. For example, the surface thereof may be pre-scored sufficiently prepare it for breakage. Moreover the tab 16 can be broken off by hand, by cutting with a suitable tool, and the like. When the tab is broken off, the friction device is no longer interlocked with door-side hinge 20, allowing the door to move freely about its hinges thereafter, as would be preferred for normal use of the vehicle after assembly. The remainder of the device may remain present as part of hinge assembly 24 during the life of the vehicle. Moreover because the remainder of the device is frictionally engaged with the hinge pin 18, it is secured within the vehicle and does not contribute to the noise within the occupant compartment. Alternatively, tab 16 may be bent such that it no longer contacts hinge members.

Tab 16 will preferably be molded as an integral part of collar 12. Alternatively, tab 16 may be made from one or more pieces of metal that have been inserted into tab 16. Tab 16 may also be snap-fit or press-fitted or ultrasonically assembled over collar 12. In certain variants of this embodiment, tab 16 may be removed without breakage and could be reusable.

Collar 12 may be made from at least one thermoplastic or thermoset polymer resin or a cast metal such as zinc or cast or extruded aluminum. It will preferably be made from a thermoplastic polymer resin. If made from a thermoplastic polymer resin, it will preferably be formed by a melt-processing procedure such as injection molding. A preferred polymer is polyamide and preferred polyamides include polyamide 6,6, polyamide 6, and semiaromatic polyamides such as terephthalamides. Preferred terephthalamides include hexamethylene adipamide/hexamethylene terephthalamide copolyamide (polyamide 6,T/6,6), hexamethylene terephthalamide/2-methylpentamethylene terephthalamide copolyamide (polyamide 6,T/D,T). The polymer resin will preferably contain reinforcing agents, which are preferably glass fibers. A particularly preferred polymer resin will be a polyamide 6,6 composition comprising about 15% to about 60% weight percent glass fibers or other reinforcing agents. Other useful polymers include polyphenylene oxides, polyphenylene sulfides, polyesters, or other engineering resins with melting points above about 175° C.

Figure 4A:
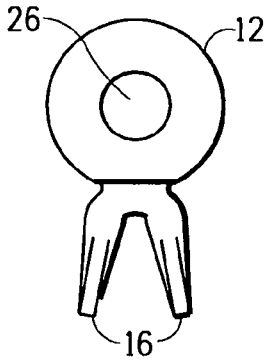
FIGS. 4A and 4B are top views of collars without or with protrusions into their open centers, respectively, both according to the present invention.
Figure 4B:
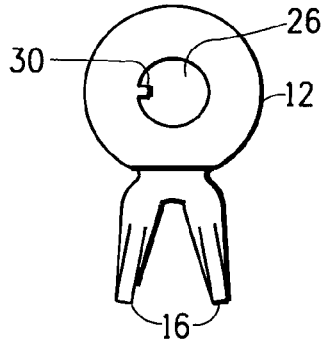
Figure 5:
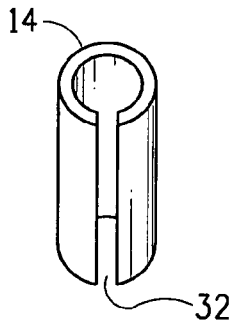
FIG. 5 is a view of a metal sleeve according to the present invention.
Figure 6:
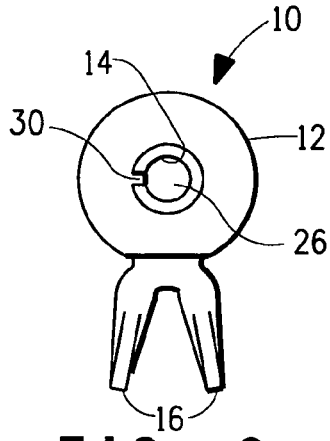
FIG. 6 is a top view of a hinge motion check friction device according to the present invention.

Referring to FIGS. 4A and 4B, there are shown two representative collars 12, with FIG. 4B depicting a protrusion 30 that juts into opening 26. Protrusion 30 may be in the form of a rib or tang or series of grooves designed to mate with a metal sleeve 14 having a single slit running its entire length. Referring to FIGS. 5 and 6, metal sleeve 14 (FIG. 5) is preferably a split metal sleeve (also called a rollpin or spring pin) having a gap 32 that is inserted into opening 26 such that the gap 32 fits around protrusion 30, interlocking metal sleeve 14 in place and preventing it from rotating within collar 12.

Other preferred methods of interlocking metal sleeve 14 with collar 12 include knurling the outside of metal sleeve 14 and/or bending one edge of metal sleeve 14 outward to form a radially-directed lip or flange that would engage a corresponding groove cut into the wall of opening 26 of collar 12. Alternatively, metal sleeve 14 could be in the form of an axially-corrugated tube of spring steel. The axial corrugation can take the form of a wave that has a form such as a sinusoidal, square wave, or other waveform. The corrugations would allow the sleeve to expand or contract radially in the direction of the wall of the opening 26.

Metal sleeve 14 will preferably be made from steel, and more preferably a high carbon steel that has been heat treated to give it a spring-like quality. The outer surface of metal sleeve 14 may be splined.

The degree of friction, and hence resistance to rotation, between friction device 10 and hinge pin 18 can be adjusted by a variety of means, including varying the difference between the inner diameter of metal sleeve 14 and the diameter of hinge pin 18; by increasing the wall thickness of metal sleeve 14; by altering the length of metal sleeve 14; by altering the heat and/or surface treatment of metal sleeve 14; and/or by changing the alloy of the metal, preferably steel, used to make metal sleeve 14 Therefore one of sufficient skill in the art to which the invention pertains can with little or no advance experimentation design into the friction device 10 the appropriate degree of friction to suit a specific purpose.

Device 10 may be assembled by inserting metal sleeve 14 into a pre-prepared collar 12 having at least one protrusion 30. Alternatively, collar 12 may be overmolded around metal sleeve 14. Notch 30 may be formed during overmolding. In another embodiment, metal sleeve 14 may be heated to a sufficiently high temperature, such that when pressed into opening 26 of collar 12 while maintaining contact with the sides of opening 26, gap 32 of metal sleeve 14 melts the polymer sufficiently to cut a notch 30. In a further embodiment, metal sleeve 14 may be inserted into collar 12 using an ultrasonic insertion method.

The force required to rotate a hinge pin inserted into device 10 of the present invention is preferably about 5 to about 60 N-m, or more preferably about 15 to about 35 N-m. when deployed for purposes of holding automobile doors in a selected position during the vehicle manufacturing process. For other purposes the preferred force will vary according to the application selected.

EXAMPLES

A starter hole was drilled into each of several 0.5 inch thick blocks cut from plaques molded from Zytel® 70G33 or Zytel® 70G43 (both of which are glass-reinforced polyamide 6,6 compositions) or a glass-reinforced hexamethylene adipamide/hexamethylene terephthalamide copolyamide. For each block, a slit steel sleeve having an outer diameter of about 12.5 mm (which was about 3 mm greater than the starter hole), an inner diameter of about 9.5 mm, and a wall thickness of about 1.5 mm was heated with a propane torch and pressed into a plaque around the starter hole until the sleeve protruded from the other side of the block. As the sleeve was inserted into the block, molten polymer flowed into the slit opening in the sleeve, forming a tongue that held the sleeve firmly and prevented it from rotating within the block. It was necessary that the sleeve be sufficiently hot to overcome the heat of fusion of the polymer, allowing it to flow around the sleeve and into the slit, but not so hot that it degraded the polymer or melted the polymer to the extent that fit around the metal sleeve was loose. Any excess plastic that came through the slit in the sleeve into the opening was removed by reaming.

The block was trimmed down and installed on a standard automobile door hinge and a hinge pin with a nut welded to its top was inserted into the sleeve inserted in the block. A standard torque wrench was used to measure the force required to rotate the hinge pins within the steel sleeves. Forces between about 15 and about 25 N-m were measured, which was deemed to be an acceptable range.

One set of test samples made from Zytel® 70G33 was heated to about 204° C. for 30 minutes. Table 1 shows the forces in N-m required to rotate the hinge pins clockwise and counter clockwise before and after heating.

TABLE 1

| | Room temperature | | After heating for 30 minutes | |
|---|---|---|---|---|
| Sample | Clockwise rotation | Counter clockwise rotation | Clockwise rotation | Counter clockwise rotation |
| 1 | 15 | 15 | 18 | see note |
| 2 | 20 | 20 | 18 | 22 |
| 3 | 30-35 | 30-35 | 30 | see note |

Note:
An accurate reading of the forces was not possible as the nut sheared off during measurement of the force.

What is claimed is:

1. A hinge motion check friction device holding a hinge connecting at least two hinge members at an arbitrary position, comprising a collar containing an opening into which is inserted a metal sleeve such that said collar and said metal sleeve are in contact and wherein said collar comprises a tab that interlocks one or more of the hinge members.

2. The device of claim 1 wherein at least one of the hinge members is attached to a vehicle door and at least another one of the hinge members is attached to a vehicle body and the door is held in a selected position relative to the body.

3. In a device for frictionally connecting hinge members at a selected position, comprising a collar containing an opening into which is inserted a metal sleeve such that said collar and said metal sleeve are in contact, the improvement comprising said metal sleeve frictionally secured within said collar and a tab secured to said collar which maintains the hinge members in the position selected.

4. A hinge comprising a hinge pin connecting two or more hinge members and interlocked to one of the members, such that the hinge members pivot relative to each other around the hinge pin and wherein the hinge pin is inserted into a hinge motion check friction device comprising a collar into which a metal sleeve is inserted, such that the collar and the metal sleeve are in contact and the hinge pin and metal sleeve are in contact and the relative motion of the hinge pin and metal sleeve is impeded by friction resistance such that a force is required to rotate the hinge pin within the hinge, and wherein the collar further comprises a tab that is in contact with a hinge member different from the one to which the hinge pin is interlocked, such that relative motion of the hinge members is impeded.

5. The hinge of claim 4 wherein at least one of the two or more hinge members connected by the hinge pin is attached to a vehicle door and at least another one of the two or more hinge members connected by the hinge pin is attached to a vehicle body.

6. The hinge of claim 4 wherein a force of about 5 to about 60 N-m is required to rotate the hinge pin within the hinge motion check friction device.

7. A method of holding a vehicle door at an selected open position relative to a vehicle body to which the door is attached via at least one hinge having a hinge pin during a painting process, comprising inserting the hinge pin through an opening in a hinge motion check friction device comprising a collar into which a metal sleeve is inserted, such that the collar and metal sleeve are in contact and the hinge pin and metal sleeve are in contact and the relative motion of the hinge pin and metal sleeve is impeded by friction resistance, wherein the hinge comprises a member attached to the door and member attached to the body, such that the hinge members are connected by and pivot relative to each other around the hinge pin, and wherein the collar further comprises a tab that is brought into contact with the member attached to the door or the member attached to the body and the hinge pin is interlocked with a hinge member different from the one to which the tab is brought into contact with, such that relative motion of the hinge members is impeded.

8. A method of painting the body of a vehicle to which is attached at least one door, comprising inserting the hinge pin through an opening in a hinge motion check friction device comprising a collar into which a metal sleeve is inserted, such that the collar and metal sleeve are in contact and the hinge pin and metal sleeve are in contact and the relative motion of the hinge pin and collar is impeded by friction resistance, wherein the hinge comprises a member attached to the door and member attached to the body, such that the hinge members are connected by and pivot relative to each other around the hinge pin, and wherein the collar further comprises a tab that is brought into contact with the member attached to the door or the member attached to the body and the hinge pin is interlocked with a hinge member different from the one to which the tab is brought into contact with, such that relative motion of the hinge members is impeded; opening the door to a predetermined position; and painting the vehicle body and/or door.

9. The device of claim 1 or 3 wherein the collar contains a protrusion around which the metal sleeve is fitted and that prevents the metal sleeve from rotating within the collar.

10. The device of claim 1 or 3 wherein the collar comprises a thermoplastic or thermoset resin.

11. The device of claim 10 wherein the thermoplastic resin is one or more of polyamide, polyphenylene oxide, polyphenylene sulfide, or polyester.

12. The device of claim 11 wherein the polyamide is selected from the group consisting of polyamide 6,6, polyamide 5, and semiaromatic polyamides.

13. The device of claim 10 wherein the thermoplastic resin comprises 15 to 60 weight percent reinforcing agents.

* * * * *